US006305967B1

(12) United States Patent
Smith, III

(10) Patent No.: US 6,305,967 B1
(45) Date of Patent: Oct. 23, 2001

(54) CONNECTOR ASSEMBLY HAVING MEANS FOR PENETRATING THE INSULATION AND ESTABLISHING ELECTRICAL CONNECTION WITH THE WIRES

(75) Inventor: Lowell J. Smith, III, Rancho Palos Verdes, CA (US)

(73) Assignee: Niles Audio Corporation, Miami, FL (US)

( * ) Notice: Subject to any disclaimer, the term of this patent is extended or adjusted under 35 U.S.C. 154(b) by 0 days.

(21) Appl. No.: 09/655,468

(22) Filed: Sep. 5, 2000

Related U.S. Application Data

(63) Continuation-in-part of application No. 09/448,358, filed on Nov. 23, 1999, now Pat. No. 6,159,035.

(51) Int. Cl.[7] ..... H01R 4/24; H01R 4/26; H01R 11/20

(52) U.S. Cl. ..... 439/391; 439/409; 439/440

(58) Field of Search ..... 439/391, 393, 439/396, 409, 410

(56) References Cited

U.S. PATENT DOCUMENTS

| | | | | |
|---|---|---|---|---|
| 3,816,819 | * | 6/1974 | Judd | 339/99 R |
| 3,877,774 | * | 4/1975 | Dorrell | 339/99 |
| 3,976,351 | * | 8/1976 | Hopfe | 339/99 R |
| 4,157,208 | | 6/1979 | Roberts et al. . | |
| 4,253,722 | | 3/1981 | Fox, Jr. . | |
| 4,270,826 | * | 6/1981 | Narozny | 339/75 MP |
| 4,451,104 | | 5/1984 | Hodgson et al. . | |
| 4,572,603 | | 2/1986 | Weidler . | |
| 4,653,187 | | 3/1987 | Sowinski . | |
| 4,793,823 | * | 12/1988 | Cozzens et al. | 439/409 |
| 4,957,452 | * | 9/1990 | Bolliger | 439/410 |
| 5,259,769 | | 11/1993 | Cruise et al. . | |
| 5,704,801 | * | 1/1998 | Walker et al. | 439/417 |
| 5,746,626 | | 5/1998 | Kwiat et al. . | |
| 5,807,133 | | 9/1998 | Arnett . | |
| 5,975,938 | * | 11/1999 | Libby | 439/410 |
| 6,036,532 | * | 3/2000 | Feiskorn | 439/495 |
| 6,159,035 | * | 12/2000 | Smith, III | 439/391 |

* cited by examiner

*Primary Examiner*—Karl D. Easthom
*Assistant Examiner*—Kyung S. Lee
(74) *Attorney, Agent, or Firm*—Lott & Friedland, P.A.

(57) ABSTRACT

A connector assembly for penetrating the insulation and establishing electrical connection with insulated electrical wires or conductors, thereby eliminating the need to strip the insulation away from the insulated wires, including a pair of mateable housing members, a pair of flexible piercing terminals and a pair of rotatable cams or levers, and which are all enclosed by the pair of mateable housing members to form a main housing. The unstripped insulated wires are respectively inserted into a pair of conductor receiving apertures on the main housing, where the cams are rotated inwardly such that the cams engage and move the piercing terminals to hold and pierce the insulated wires to establish electrical connection thereto.

29 Claims, 7 Drawing Sheets

FIG.8
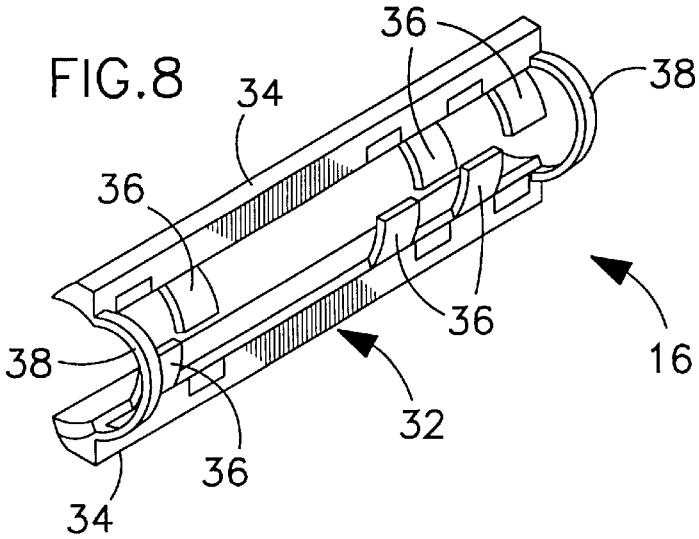
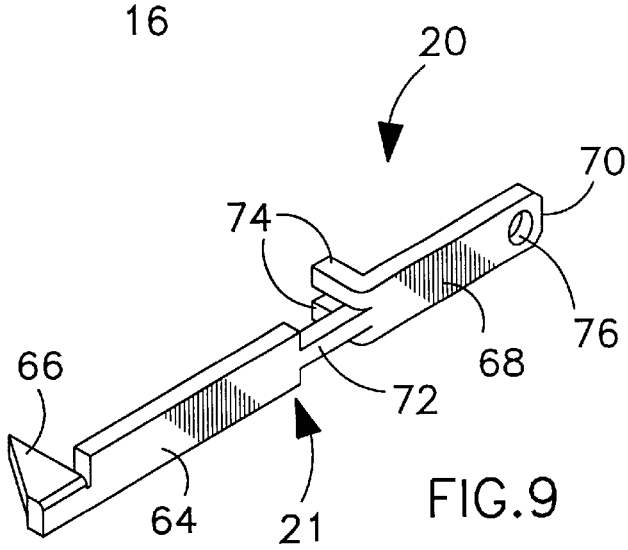
FIG.9
FIG.10
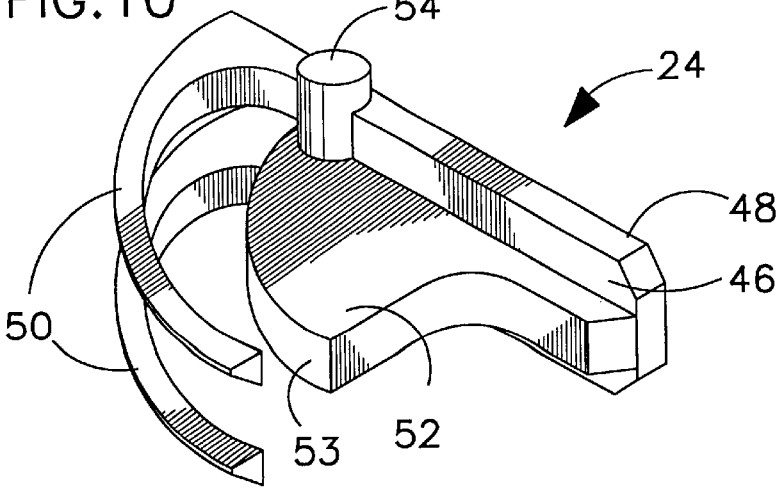

CONNECTOR ASSEMBLY HAVING MEANS FOR PENETRATING THE INSULATION AND ESTABLISHING ELECTRICAL CONNECTION WITH THE WIRES

This application is a continuation-in-part of application Ser. No. 09/448,358 filed on Nov. 23, 1999, now a U.S. Pat. No. 6,159,035.

BACKGROUND OF THE INVENTION

1. Field of the Invention

The present invention generally relates to the field of connector assemblies. More particularly, the present invention relates to the field of connector assemblies having means for penetrating the insulation and establishing electrical connection with the insulated electrical wires.

2. Description of the Prior Art

Specifically, connectors are well known in the art. These prior art connectors are used for establishing electrical connection between electronic devices. While many prior art connectors are adequate in a number of applications, there is still a need for improvement. Most of the known termination methods have required some type of insulation striping or other preparation prior to making an electrical connection.

The following eight (8) prior art patents are found to be pertinent to the field of the present invention:

1. U.S. Pat. No. 4,157,208 issued to Roberts et al. on Jun. 5, 1979 for "Waterproof Splice Electrical Connector" (hereafter the "Roberts Patent");
2. U.S. Pat. No. 4,451,104 issued to Hodgson et al. on May 29, 1984 for "Apparatus For Splicing Electric Wires" (hereafter the "Hodgson Patent");
3. U.S. Pat. No. 4,253,722 issued to Fox, Jr. on Mar. 3, 1981 for "Insulation Pierce-Type Connector For Ribbon Cable" (hereafter the "Fox Patent");
4. U.S. Pat. No. 4,572,603 issued to Weidler on Feb. 25, 1986 for "Connector For Terminating Small Gauge Magnet Wire" (hereafter the "Weidler Patent");
5. U.S. Pat. No. 4,653,187 issued to Sowinski on Mar. 31, 1987 for "Connector Fabrication Method And Apparatus" (hereafter the "Sowinski Patent");
6. U.S. Pat. No. 5,259,769 issued to Cruise et al. on Nov. 9, 1993 for "Electrical Connector With Preloaded Spring-Like Terminal With Improved Wiping Action" (hereafter the "Cruise Patent");
7. U.S. Pat. No. 5,746,626 issued to Kwiat et al. on May 5, 1998 for "Electrical Connector Assembly" (hereafter the "Kwiat Patent"); and
8. U.S. Pat. No. 5,807,133 issued to Arnett on Sep. 15, 1998 for "Insulation Displacement Connector" (hereafter the "Amnett Patent").

The Roberts Patent discloses a waterproof splice electrical connector. The connector includes an outer casing which receives a cylindrical plug member. A circular plate-like contact terminal is mounted between the plug member and a base, and both are mounted within a third casing member. The terminal is free to rotate through a prescribed arc with respect to the plug member and the base. When the plug assembly is in turn mounted in the outer casing, the plug assembly is also rotatable through a similar prescribed arc relative to the outer casing. In the assembled configuration, the terminal is fixed relative to the outer casing. Two or more wires can then be spliced by inserting the wires into the plug assembly and imparting relative rotation between the outer casing and the plug assembly. During rotation, insulation piercing members on the terminal establish the electrical interconnection between the wires.

The Hodgson Patent discloses an apparatus for splicing electric wires. It comprises a housing which has two channels with each channel extending through the housing from an entrance opening to an exit opening. The housing further comprises a partition located between the channels, a ramped surface on a wall in each channel opposite the partition with the ramped surface widening each channel as it extends from the entrance opening to the exit opening and an electrically conductive terminal embedded in the partition which has tangs extending into each at an angle inclined toward the exit opening of each channel. A pair of wedges are provided for insertion into the exit end of each channel. After an electric wire is inserted into each channel through the entrance end by a sufficient distance into the channel until the wire at least overlays the tangs of the terminal, a wedge is forced into the exit end of each channel to force the inserted electric wire down onto the tangs of the terminal to make electrical contact with the terminal and to force the electric wire into locked engagement between the partition and the inserted wedge in each channel.

The Fox Patent discloses an insulation pierce-type connector for a ribbon cable. It comprises a base and a mating cover joined together to clamp a multi-conductor flat flexible cable. The cover and base have aligned cavities for accommodating contact elements which are inserted through the top of the cover after the cable is clamped. The elements have insulation piercing slots so that each element slices through the conductor insulation to electrically engage a conductor wire and are shaped so as to hold the base and cover in engagement after contact is achieved with conductor wires.

The Weidler Patent discloses a connector for terminating small gauge magnet wires. It comprises a terminal which is a one-piece metal strip. The strip has a bowed wire engaging portion with a convex, serrated, wire engaging surface and mounting arms extending in the direction of the bow from opposite ends.

The Sowinski Patent discloses a connector fabrication method and apparatus for voiding selected terminals from a connector assembly wherein an array of terminals, joined to a common carrier member, are partially preloaded in a connector housing. The apparatus includes a punch having a first projection which engages and deforms the terminal. The punch further includes a second projection following the first projection, for severing the terminal from the carrier strip. The selected terminals are disengaged and extracted from the connector housing and severed from the carrier member, at the voiding station.

The Cruise Patent discloses an electrical connector with a preloaded spring-like terminal with an improved wiping action. The electrical connector includes a dielectric body mounting a flexible leaf-type terminal which has a spring contact portion for surface engagement with a contact element of a mating connector component.

The Kwiat Patent discloses an electrical connector assembly for facilitating the establishment of an electrical connection with a terminal on an electrical component when the component and the connector assembly are brought toward each other.

The Arnett Patent discloses an insulation displacement connector for facilitating an electrical contact with an insulated wire conductor. The connector has a wire passage to receive an insulated wire conductor, and capturing a contact member which has an electrically conductive hook portion in the housing. An end of the hook portion projects into the wire passage. When an insulated wire conductor is fed into the passage, insulation on the conductor slides along the hook portion of the contact member. Upon withdrawing or displacing the conductor a certain distance relative to the hook portion, an end of the hook portion engages and pierces the insulation on the conductor to make electrical contact with the conductor.

It is highly desirable to have a very efficient and also very effective design and construction of a connector assembly having means for penetrating the insulation and establishing electrical connection with the insulated electrical wires, thereby eliminating the need to strip the insulation from the insulated wires. It is desirable to provide a connector assembly with the capability of rapidly establishing an electrical connection without the need to strip the insulation away from the insulated wires.

The inventor and applicant of this patent application is aware of the following additional eight (8) prior art patents and they are listed below:

1. U.S. Pat. No. 3,816,819 issued to Judd;
2. U.S. Pat. No. 3,877,774 issued to Dorrell;
3. U.S. Pat. No. 3,976,351 issued to Hopfe;
4. U.S. Pat. No. 4,270,826 issued to Narozny;
5. U.S. Pat. No. 4,793,823 issued to Cozzens et al.;
6. U.S. Pat. No. 4,957,452 issued to Bolliger;
7. U.S. Pat. No. 5,704,801 issued to Walker et al.; and
8. U.S. Pat. No. 5,975,938 issued to Libby.

SUMMARY OF THE INVENTION

The present invention is a connector assembly having means for penetrating the insulation and establishing electrical connection with insulated electrical wires or conductors, thereby eliminating the need to strip the insulation away from the insulated wires.

The connector assembly comprises a pair of mateable housings, a pair of conductor guides, a pair of flexible piercing terminals and a pair of rotatable cams or levers, and which are all enclosed by the pair of mateable housings. The unstripped insulated wires are respectively inserted into and positioned within the pair of conductor guides, where the cams are rotated inwardly such that the cams engage and squeeze the conductor guides to retain the insulated wires thereto. While the cams are being rotated, they also engage the piercing terminals such that knife ends pierce the insulated wires or conductors to establish electrical connection thereto.

It is therefore an object of the present invention to provide a connector assembly for use in terminating insulated electrical wires or conductors and which can be applied to the insulated wires without special tools.

It is also an object of the present invention to provide a connector assembly which includes flexible piercing terminals for penetrating the insulation and establishing electrical connection with electrical wires or conductors, thereby eliminating the need to strip the insulation away from the insulated wires prior to establishing the electrical connection.

It is an additional object of the present invention to provide a connector assembly which includes adaptable wire guides, so that a plurality of different sized diameter insulated wires or conductors may be used with the connector assembly.

It is a further object of the present invention to provide a connector assembly which includes rotatable cams or levers, where the cams are rotated to engage and squeeze conductor guides to retain the insulated conductors thereto and the cams are further engaged with the piercing terminals to make an electrical connection with conductors thereto.

Alternatively, the present invention is a connector assembly having means for penetrating the insulation and establishing electrical connection with insulated electrical wires or conductors, thereby eliminating the need to strip the insulation away from the insulated wires. In addition, the connector assembly can be reused without replacing any components in the connector assembly.

The connector assembly comprises a pair of mateable housing members, a pair of flexible piercing terminals and a pair of rotatable cams or levers, and which are all enclosed by the pair of mateable housing members to form a main housing. The unstripped insulated wires are respectively inserted into a pair of conductor receiving apertures on the main housing, where the cams are rotated inwardly such that the cams engage and move the piercing terminals to hold and pierce the insulated wires to establish electrical connection.

It is therefore an object of the present invention to provide a connector assembly for use in terminating insulated electrical wires or conductors and which can be applied to the insulated wires without special tools.

It is also an object of the present invention to provide a connector assembly that is adaptable to a plurality of different sized diameter insulated wires or conductors without using special adapters or adjustment by the user.

It is an additional object of the present invention to provide a connector assembly which includes flexible piercing terminals for penetrating the insulation and establishing electrical connection with electrical wires or conductors, thereby eliminating the need to strip the insulation away from the insulated wires prior to establishing the electrical connection.

It is a further object of the present invention to provide a connector assembly which includes rotatable cams or levers, where the cams are rotated to engage the piercing terminals to make an electrical connection with conductors.

It is still a further object of the present invention to provide a connector assembly that can be reused without replacing any components in the connector assembly.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 8 is an enlarged perspective of one of the two adaptable conductor guides of the present invention connector assembly;

FIG. 9 is an enlarged perspective of one of the two rotatable cams of the present invention connector assembly;

FIG. 10 is an enlarged perspective of one of the two flexible piecing terminals of the present invention connector assembly;

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
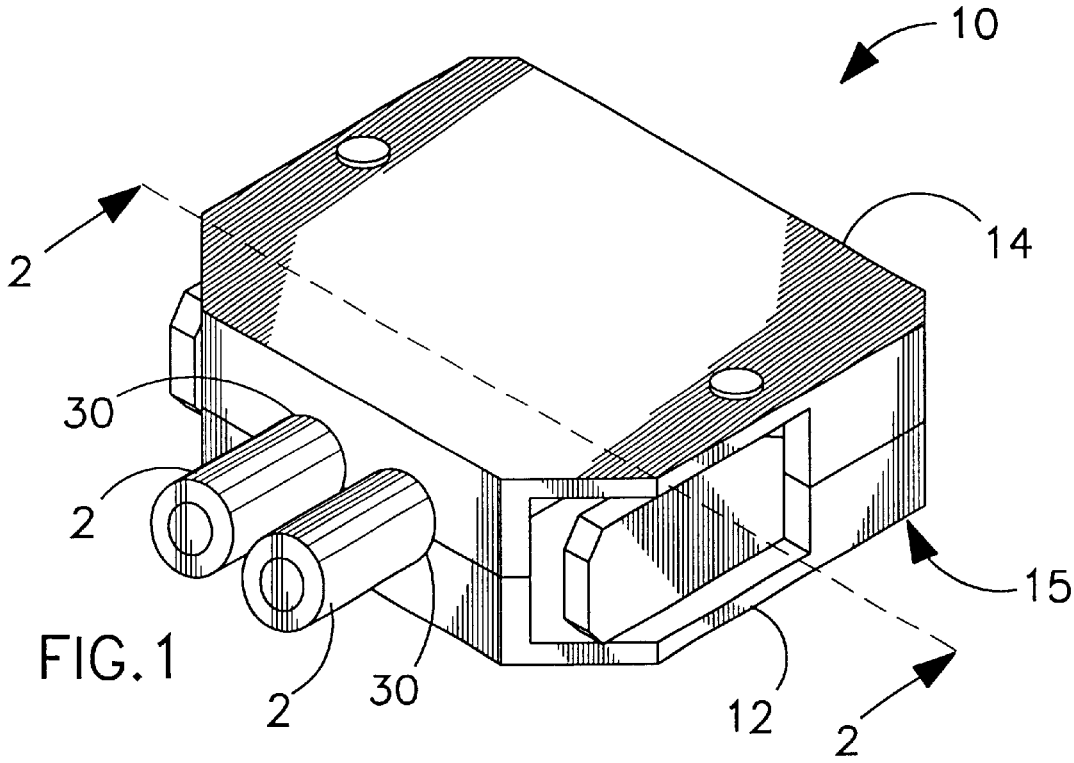
FIG. 1 is a perspective view of the present invention connector assembly fully assembled, with insulated electrical conductors installed thereto.
Figure 2:
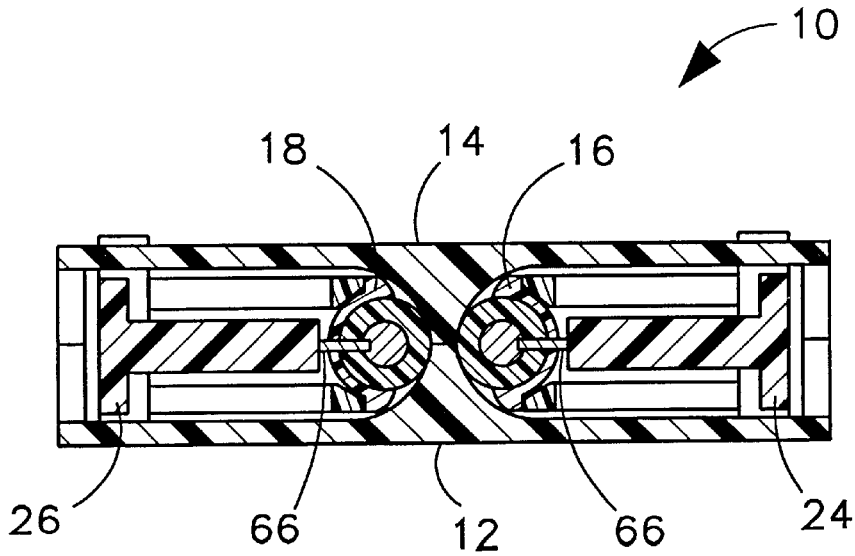
FIG. 2 is a cross-sectional view taken along line 2—2 of FIG. 1.

Referring to FIG. 1, there is shown at 10 a perspective view of the present invention connector assembly fully assembled, with insulated conductors or wires 2 installed thereto. The connector assembly 10 has means for penetrating the insulation and quickly facilitating and establishing electrical connection with insulated conductors 2.

Figure 3:
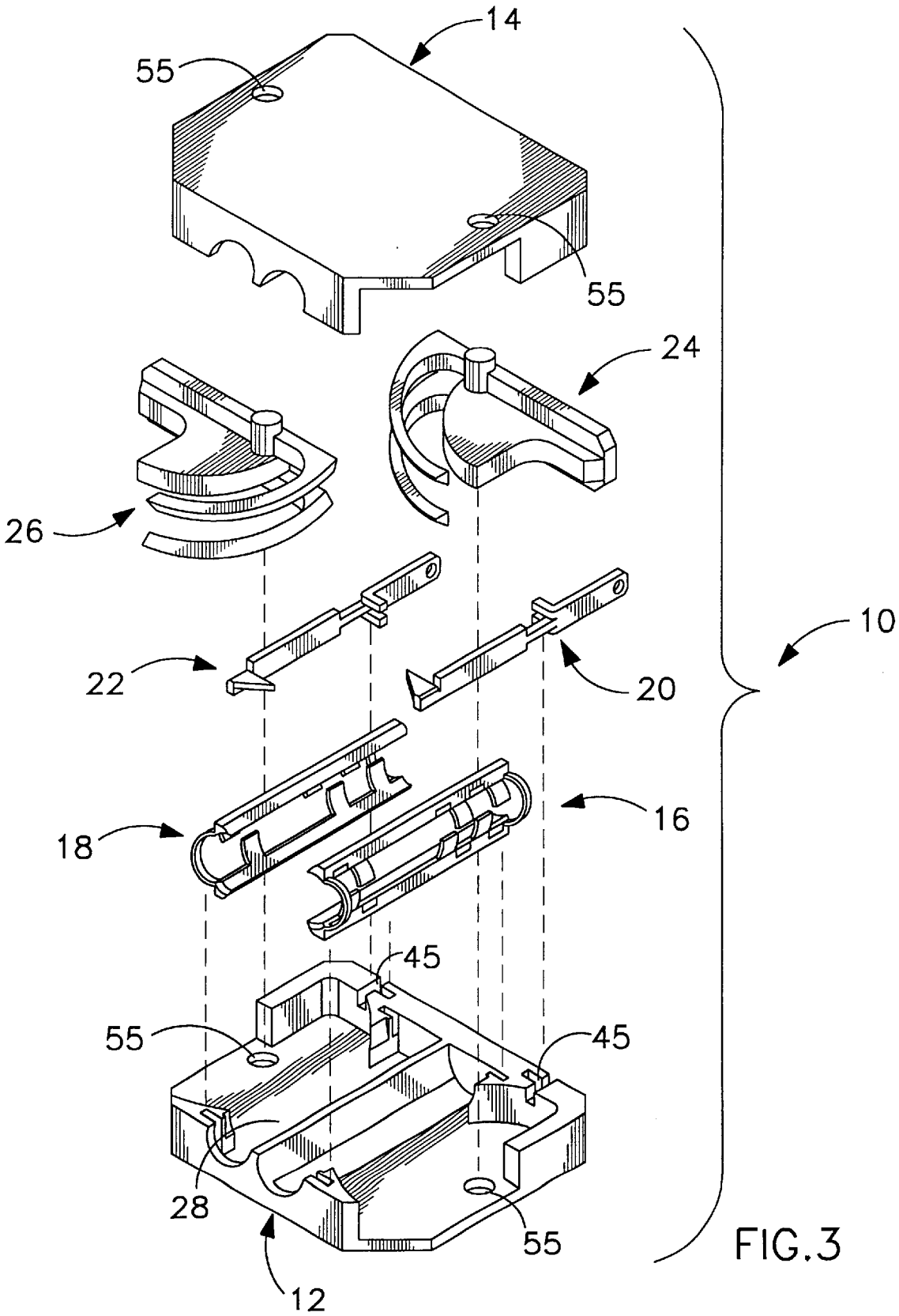
FIG. 3 is an exploded perspective view of the present invention connector assembly.
Figure 4:
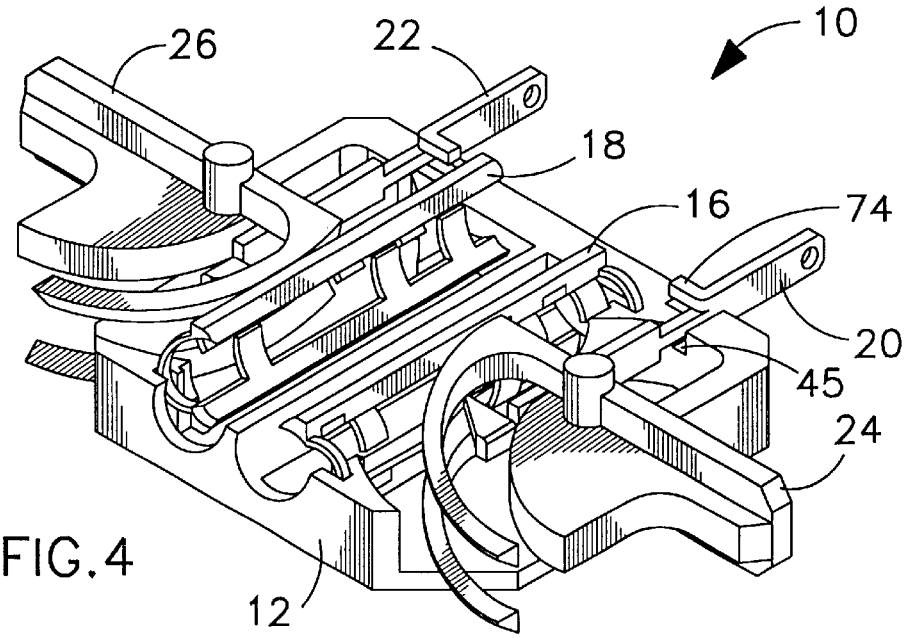
FIG. 4 is a perspective view of the present invention connector assembly, showing various components of the connector assembly, without one of the two housings and without the conductors installed thereto.

FIG. 3 shows an exploded perspective view of the present invention connector assembly 10. FIG. 4 shows a perspective view of the present invention connector assembly 10 in the unterminated position or condition, before the insulated conductors 2 are installed and pierced. Referring to FIGS. 3 through 10, the connector assembly 10 comprises a first half housing or shell 12, a complementary second half housing or shell 14, a pair of adaptable conductor guides 16 and 18, a pair of flexible piercing terminals 20 and 22, and a pair of rotatable cams or levers 24 and 26.

Each housing has a conformed interior compartment 28 which includes a conductor guide location, a piercing terminal location and a cam location. The two housings 12 and 14 are interconnected together to form a main housing 15 for respectively retaining and securing the conductor guides 16 and 18, the piercing terminals 20 and 22, and the rotatable cams 24 and 26 to the guide locations, the piercing terminal locations and the cam locations of the two half housings 12 and 14. When formed, the main housing 15 has at least two spaced apart apertures 30 (see FIG. 1) located in the longitudinal direction for allowing the insulated conductors 2 to be inserted thereto and two pairs of spaced apart apertures 55 located in the transverse direction. The housings 12 and 14 are constructed of electrically non-conductive material.

For ease of understanding, only the components on the left side of the connector assembly 10 will be described in detail since it should be understood that the components on tie right side of the connector assembly 10 are a substantially identical mirror image, and to the extent they are, only the components on the left side of the connector assembly 10 will be described in detail.

Referring to FIGS. 3 through 8, the conductor guide 16 has a semi-cylindrical body 32 which includes two opposite ridges 34 extending along the longitudinal direction of the conductor guide 16, two opposite arch shaped ends 38 integrally connected to the two opposite ridges 34, and a plurality of flanges or fingers 36 which extend in the transverse direction of the semi-cylindrical body 32. The conductor guide 16 is positioned and secured between the interior compartments 28 of the first and second housings 12 and 14, where the conductor guide 16 forms a conductor passage which is aligned with one of the at least two spaced apart apertures 30 of the main housing 15 for retaining a plurality of different sized diameter conductors of the insulated conductors 2.

Referring to FIGS. 3, 4, 5, 6, 7, and 9, the piercing terminal 20 is constructed of electrically conductive material and has an elongated thin flat body 21 which includes a flexible portion 64 with a knife shaped or piercing end 66, a semi-rigid portion 68 with a connection end 70, and a narrow middle portion 72 interconnecting the flexible portion 64 with the semi-rigid portion 68. There are also provided a pair of flanges 74 on opposite sides of the middle portion 72 and located between the middle portion 72 and the semi-rigid portion 68 for reinforcing the semi-rigid portion 64 from being bent. The connection end 70 may have an aperture 76 for providing connection means to the electronic devices, electrical speaker wires, etc. The piercing terminal 20 is positioned and secured between the interior compartments 28 of the first and second housings 12 and 14, such that the flanges 74 are positioned within recesses 45 provided by the first and second housings 12 and 14, and the connection end 70 extends out from the main housing 15 while the knife shaped end 66 is located adjacent to the conductor guide 16.

Referring to FIGS. 3, 4, 5, 6, 7 and 10, the rotatable cam 24 includes a straight or handle portion 48 and a pair of spaced apart arch shaped arms 50 integrally connected to one end of the straight portion 48. There is provided an arch shaped engagement portion 52 which is integrally formed with the interior side 46 of the straight portion 48. There are also provided two transverse protruding bosses 54 (only one is shown) located on opposite sides of the straight portion 48 of the rotatable cam 24. The rotatable cam 24 is positioned and secured between the interior compartments 28 of the first and second housings 12 and 14, such that the two protruding bosses 54 are inserted into the apertures 55 provided by the first and second housings 12 and 14. In the unterminated position or condition, the handle portion 48 extends out from the main housing 15 while the pair of arch shaped arms 50 are partially within the main housing 15.

Figure 5:
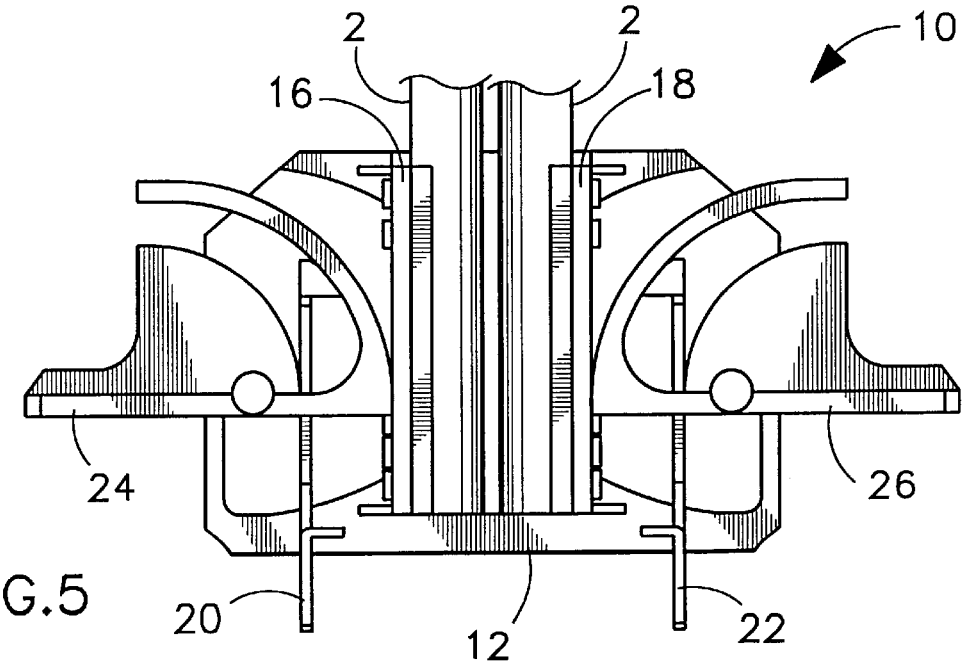
FIG. 5 is a plan view showing the unterminated position of the present invention connector assembly without one of the two housings and the conductors installed thereto.
Figure 6:
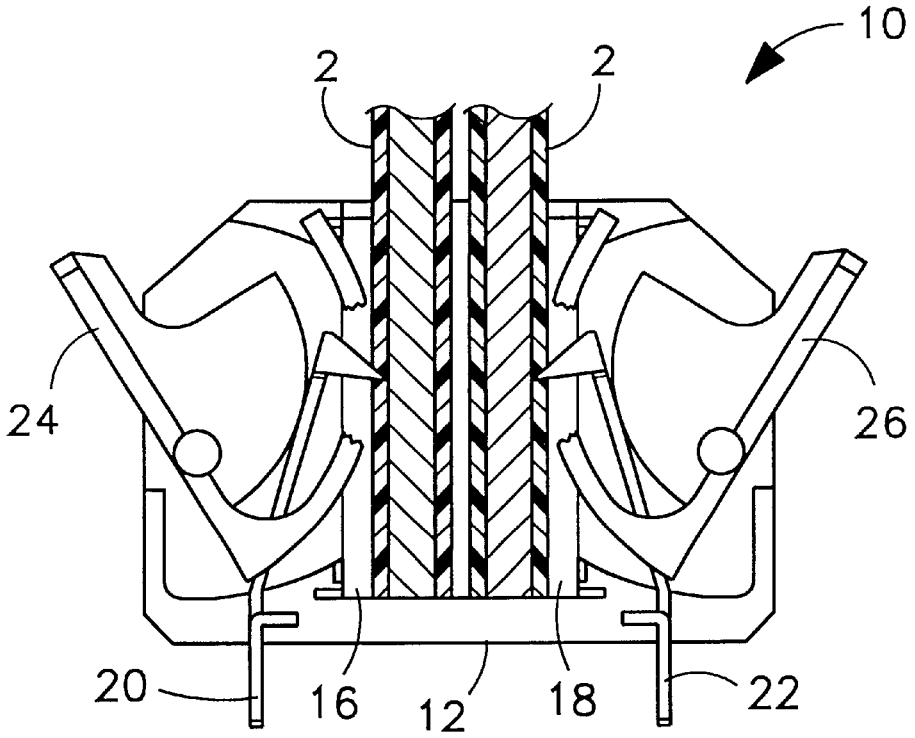
FIG. 6 is a plan view of the present invention connector assembly, showing the flexible piercing terminals piercing the insulation of the insulated conductors.
Figure 7:
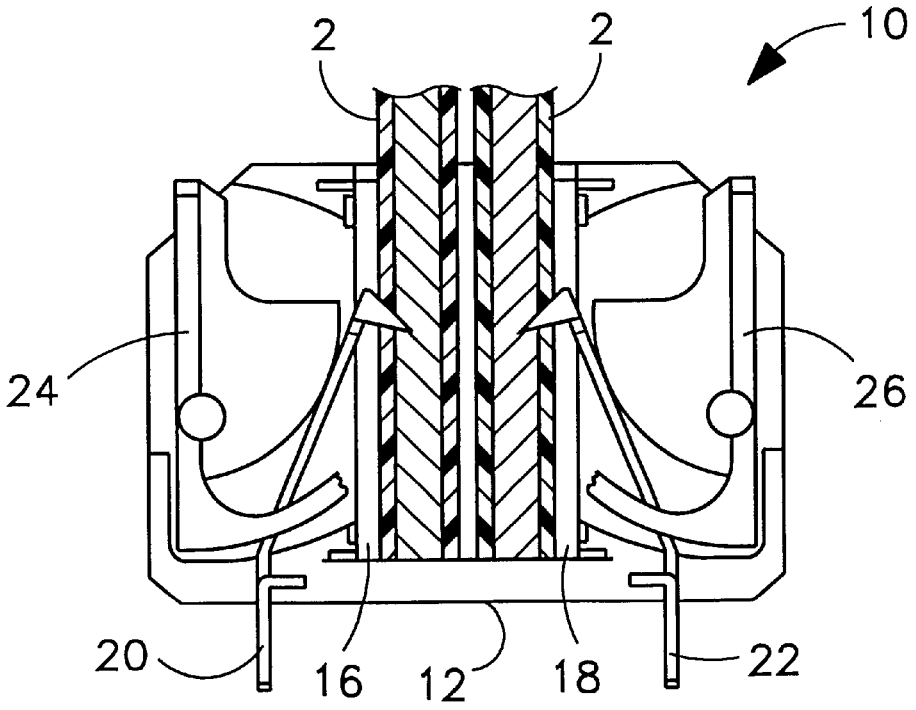
FIG. 7 is a plan view showing the terminated position of the present invention connector assembly, where the flexible piecing terminals establish electrical connection with the insulated conductors.

FIG. 5 shows the present invention connector assembly 10 in its unterminated position or condition, before the insulated conductors 2 are pierced. FIG. 6 shows the present invention connector assembly 10, where the knife shaped ends 66 of flexible piercing terminals 20 and 22 pierce the insulation of the insulated conductors 2. FIG. 7 shows the present invention connector assembly 10 in its terminated position or condition, where the knife shaped ends 66 of the flexible piecing terminals establish electrical connection with the insulated conductors 2. Referring to FIGS. 1 through 10, the unstripped conductors 2 are respectively inserted into the apertures 30 provided by the main housing 15 and positioned within the conductor guides 16 and 18. The handle portions 48 of the rotatable cams 24 and 26 are rotated inwardly such that the arch shaped arms 50 engage and push the ridges 34 of the conductor guides 16 and 18 together to squeeze and secure the conductors 2 thereto (see FIG. 2). While the rotatable cams 24 and 26 are being rotated, engagement surfaces 53 of the engagement portions 52 engage and push the flexible portions 64 of the piercing terminals 20 and 22 inwardly such that the knife shaped ends 66 pierce the insulated electrical wires or conductors 2 to establish electrical connection thereto.

The present invention has many advantageous features including: (a) the user does not have to strip the insulation away from the conductors prior to establishing an electrical connection; and (b) the conductor guides will automatically accept conductors between 10 gauge wires through 20 gauge wires without special adapters or adjustment by the user.

The benefit of present invention is easy installation which carries over from custom install in-wall speakers and ceiling speakers to standard floor-standing speakers as well as consumer electronics.

The present invention conforms to conventional forms of manufacture or any other conventional way known to one skilled in the art.

Figure 11:
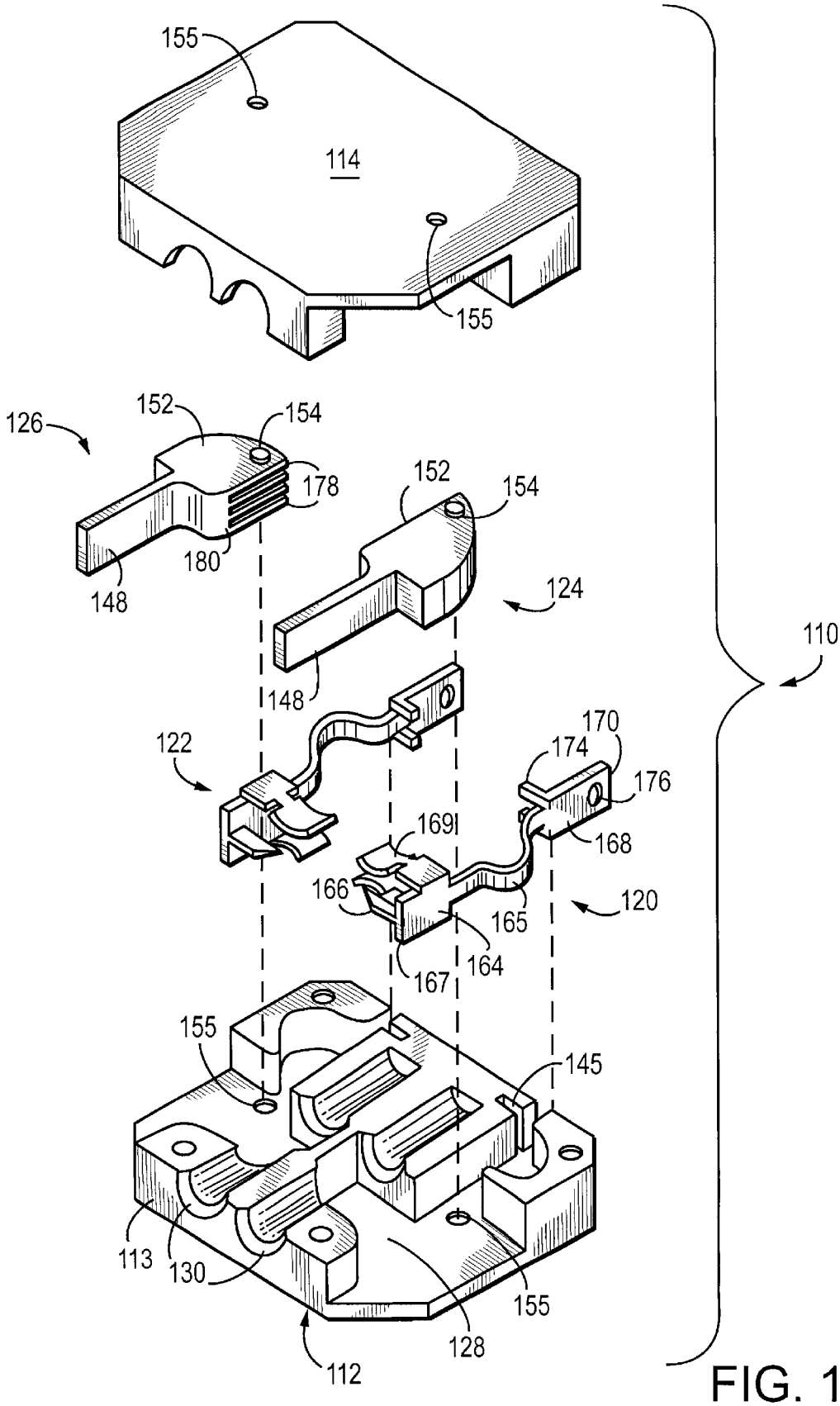
FIG. 11 is an exploded perspective view of an alternative present invention connector assembly.
Figure 12:
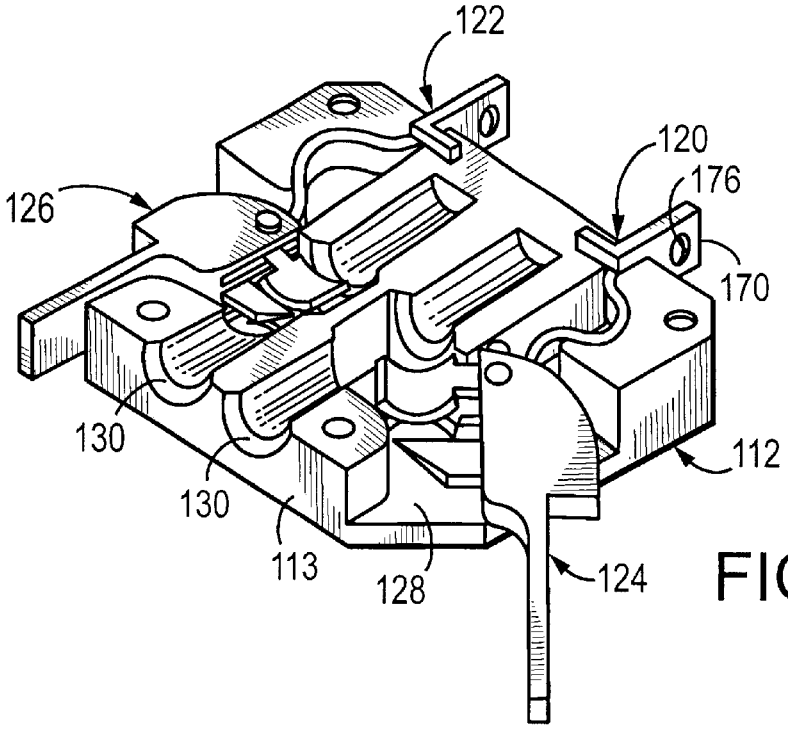
FIG. 12 is a perspective view of the present invention connector assembly shown in FIG. 11, showing various components of the connector assembly, without one of the two housing members and without the insulated conductors installed to the connector assembly.
Figure 13:
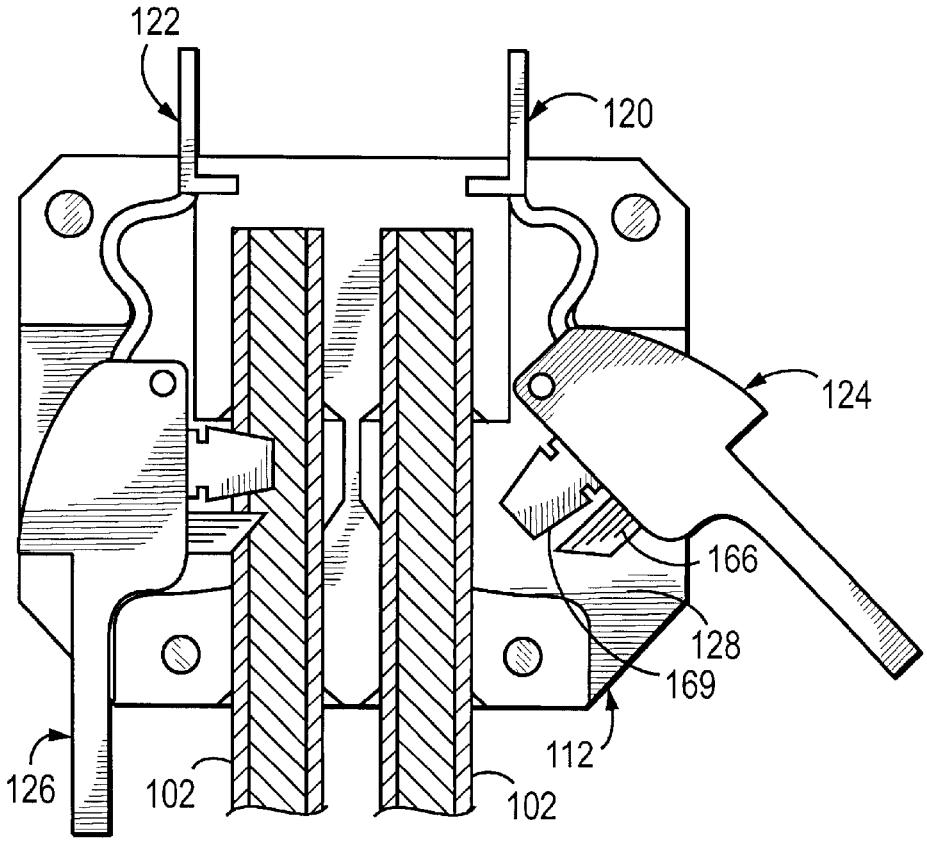
FIG. 13 is a partial plan view of the present invention connector assembly shown in FIG. 11, showing one of the two flexible piercing terminals piercing the insulation of one of the two insulated conductors installed to one of two housing members of the connector assembly.

Referring to FIGS. 11 through 13, described briefly, alternatively the present invention connector assembly 110 has means for penetrating the insulation and quickly facilitating and establishing electrical connection with insulated conductors 102. In addition, the present invention connector assembly 110 can be reused without replacing any components.

FIG. 11 shows an exploded view of the present invention connector assembly 110. FIG. 12 shows a perspective view of the present invention connector assembly 110 in the unterminated position or condition, before the insulated conductors 102 are installed and pierced. FIG. 13 is a partial plan view of the present invention connector assembly 110, showing one of the two flexible piercing terminals 124 piercing the insulation of one of the two insulated conductors 102.

Referring to FIGS. 11 through 13, the connector assembly 10 comprises a first half housing member or shell 112, a complementary second half housing member or shell 114, a pair of elongated flexible piercing terminals 120 and 122, and a pair of rotatable cams or levers 124 and 126.

Each of the first and second housing members 112 and 114 has a conformed interior compartment 128 which includes two half conductor channels, two piercing terminal locations and two cam locations. The first and second housing members 112 and 114 are interconnected together to form a main housing for respectively retaining and securing the piercing terminals 120 and 122, and the rotatable cams 124 and 126 to the piercing terminal locations and the cam locations of the two half members 112 and 114. When formed, the main housing has at least two spaced apart apertures 130 (see FIG. 12) located at one end 113 aligned in the longitudinal direction for allowing the insulated conductors 102 to be inserted therethrough and two pairs of spaced apart apertures 155 (see FIG. 11) located in the transverse direction. The half members 112 and 114 are constructed of electrically non-conductive material.

For ease of understanding, only the components on the right side of the connector assembly 110 will be described in detail since it should be understood that the components on the left side of the connector assembly 110 are a substantially identical mirror image, and to the extent they are, only the components on the right side of the connector assembly 110 will be described in detail below.

The piercing terminal 120 is constructed of electrically conductive material and has a movable section 164, a semi-rigid contact section 168, and a flexible connection section 165 integrally connected between the movable section 164 and the contact section 168. The movable section 164 has a knife or piercing means 166 located adjacent to an end 167 of the movable section 164 and a pair of outwardly curved retaining arms or means 169 located adjacent to the piercing means 166. The contact section 168 has a pair of parallel flanges 174 for securing the piercing terminal 120 to the main housing. The connecting end 170 may have an aperture 176 for providing connection means to connect to the electronic devices, electrical speaker wires, etc. The piercing terminal 120 is positioned and secured between the interior compartments 128 of the first and second half members 112 and 114, such that the flanges 174 are positioned within recesses 145 provided by the first and second half members 112 and 114, and the connection end 170 extends out from the other end of the main housing while the movable section 164 is located within the main housing.

Referring to FIG. 11, the rotatable cam 124 includes a straight or handle section 148 and an engagement section 152. There are also provided two transverse protruding bosses 154 (only one is shown) located on opposite sides of the rotatable cam 124. Referring to the left rotatable cam 126, the engagement section 152 has at least three slots 178 located on the engagement side 180 for accommodating the piercing means 166 and the pair of retaining arms 169 of the piercing terminal 122. The piercing means 166 and the retaining arms 169 slide within the engagement section 152 and are secured thereto. The rotatable cam 124 is positioned and secured between the interior compartments 128 of the first and second half members 112 and 114, such that the two protruding bosses 154 are inserted into the apertures 155 provided by the first and second half members 112 and 114. In the unterminated position or condition, the handle section 148 extends out from the main housing while the engagement section 152 is located within the main housing.

Referring to FIGS. 11 through 13, the knife means 166 of the flexible piercing terminals 120 and 122 pierce the insulation of the insulated conductors 102. In its terminated position or condition of the connector assembly 110, the knife means 166 of the flexible piecing terminals 120 and 122 establish electrical connection with the insulated conductors 102 (see FIG. 13). The unstripped conductors 102 are respectively inserted into the apertures 130 provided by the main housing and positioned within the conductor channels of the main housing. The handle sections 148 of the rotatable cams 124 and 126 are rotated inwardly such that the engagement sections 152 engage and move the movable sections of the piercing terminals 120 and 122 to the conductors 102 while the retaining means hold the conductors 102 thereto while the piercing means pierce the insulation of the insulated conductors to establish the electrical connections. While the rotatable cams 124 and 126 are being rotated, the engagement sections engage and move the movable sections 164 of the piercing terminals 120 and 122 inwardly such that the knives 166 pierce the insulated electrical wires or conductors 102 to establish electrical connection thereto.

One of the unique features of the present invention connector assembly is that the connector assembly can be reused without replacing any components. The reason why the connector assembly can be reused is that the piercing terminal 120 does not break off after one usage. With the flexible connection section 165 incorporated between the movable section 164 and the contact section 168, the piercing terminal 120 will not break-off and can be used many times over without breaking.

The present invention has many advantageous features including: (a) the user does not have to strip the insulation away from the conductors prior to establishing an electrical connection; (b) the connector assembly can accept insulated conductors between 8 gauge wires through 22 gauge wires without special adapters or adjustment by the user;

The benefit of present invention is easy installation which carries over from custom install in-wall speakers and ceiling speakers to standard floor-standing speakers as well as consumer electronics.

The present invention conforms to conventional forms of manufacture or any other conventional way known to one skilled in the art.

Defined in detail, the present invention is a connector assembly for quickly facilitating and establishing electrical connection with a pair of insulated conductors, the connector assembly comprising: (a) a first half housing member having an interior compartment; (b) a complementary second half housing member having an interior compartment which is a mirror image of the interior compartment of the first half housing member and mateable with the first half housing member to form a main housing with a pair of spaced apart conductor receiving apertures located at one end of the main housing for receiving a plurality of different sized diameter insulated conductors of the pair of insulated conductors; (c) a pair of spaced apart flexible piercing terminals positioned and secured within the interior compartments of the first and second housing members and located parallel to each other, each piercing terminal having a movable section, a contact section with a connecting end extending out from the other end of the main housing and a flexible connection section integrally connecting the movable section and the contact section, the movable section having a piercing means extending inwardly and located adjacent to an end of the movable section and a retaining means located adjacent to the piercing means; and (d) a pair of rotatable cams rotatably positioned and secured within the interior compartments of the first and second members and respectively located adjacent to the pair of piercing terminals, each rotatable cam having an engagement section abutting against the movable section of the each piercing terminal and a handle section extending out from the main housing for rotating the engagement section to engage and move the movable section of the each piercing terminal inwardly, such that the retaining means of the movable section of the each piercing terminal engages and holds the each insulated conductor thereto while the piercing means of the movable section of the each piercing terminal pierces the insulation of the each insulated conductor to establish the electrical connection thereto.

Defined broadly, the present invention is a connector assembly for quickly facilitating and establishing electrical connection with at least two insulated conductors, the connector assembly comprising: (a) a first half member; (b) a complementary second half member mateable with the first half member to form a main housing with at least two spaced apart apertures for receiving a plurality of different sized diameter insulated conductors of the at least two insulated conductors; (c) at least two piercing terminals positioned and secured between the first and second members and located parallel to each other, each piercing terminal having a movable section, a contact section extending out from the main housing and a flexible connection section connecting the movable section and the contact section, the movable section having a piercing means extending inwardly and a retaining means located adjacent to the piercing means; and (d) at least two cams rotatably positioned and secured between the first and second members and respectively located adjacent to the at least two piercing terminals, each cam having an engagement section abutting against the movable section of the each piercing terminal and a handle section extending out from the main housing for rotating the engagement section to engage and move the movable section of the each piercing terminal inwardly, such that the retaining means of the movable section of the each piercing terminal engages and holds the each insulated conductor thereto while the piercing means of the movable section of the each piercing terminal pierces the insulation of the each insulated conductor to establish the electrical connection thereto.

Defined more broadly, the present invention is a connector assembly for quickly facilitating and establishing electrical connection with at least two insulated conductors, the connector assembly comprising: (a) a first half member; (b) a complementary second half member mateable with the first half member to form a main housing with at least two spaced apart apertures for receiving a plurality of different sized diameter insulated conductors of the at two least insulated conductors; (c) at least two piercing terminals installed between the first end second members, each piercing terminal having a movable section, a contact section extending out from the main housing and a flexible section connecting the movable section and the contact section, the movable section having a piercing means and a retaining means; and (d) means for engaging and moving the movable section of the each piercing terminal, such that the retaining means of the movable section of the each piercing terminal engages and holds the each insulated conductor thereto while the piercing means of the movable section of the each piercing terminal pierces the insulation of the each insulated conductor to establish the electrical connection thereto.

Defined even more broadly, the present invention is a connector assembly for quickly facilitating and establishing electrical connection with at least one insulated conductor, the connector assembly comprising: (a) a first half member; (b) a second half member mateable with the first half member to form a main housing with at least one aperture for receiving a plurality of different sized diameter conductors of the at least one insulated conductor; (c) at least one piercing terminal installed between the first and second members and having a movable section, a contact section and a flexible section connecting the movable section and the contact section, the movable section having means for holding and penetrating the insulation of the at least one insulated conductor; and (d) at least one cam rotatably installed between the first and second members and having means for engaging and moving the movable section, such that the holding and penetrating means engages and holds the at least one insulated conductor thereto while piercing the insulation of the at least one insulated conductor to establish the electrical connection thereto.

Further defined even more broadly, the present invention is a connector for quickly facilitating and establishing electrical connection with at least one insulated conductor, the connector comprising: (a) a shell having at least one aperture for receiving the at least one insulated conductor thereto; (b) at least one piercing terminal installed within the shell and having a movable section, a contact section and a flexible section connecting the movable section and the contact section, the movable section having a piercing means and a retaining means; and (c) means for engaging and moving the movable section such that the retaining means engages and holds the at least one insulated conductor thereto while the piercing means pierces the insulation of the at least one insulated conductor to establish the electrical connection thereto.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A connector assembly for quickly facilitating and establishing electrical connection with a pair of insulated conductors, the connector assembly comprising:

a. a first half housing member having an interior compartment;

b. a complementary second half housing member having an interior compartment which is a mirror image of said interior compartment of said first half housing member and mateable with said first half housing member to form a main housing with a pair of spaced apart conductor receiving apertures located at one end of the main housing for receiving a plurality of different sized diameter insulated conductors of said pair of insulated conductors;

c. a pair of spaced apart flexible piercing terminals positioned and secured within said interior compartments of said first and second housing members and located parallel to each other, each piercing terminal having a movable section, a contact section with a connecting end extending out from the other end of said main housing and a flexible connection section integrally connecting the movable section and the contact section, the movable section having a piercing means extending inwardly and located adjacent to an end of the movable section and retaining means located adjacent to the piercing means; and d. a pair of rotatable cams rotatably positioned and secured within said interior compartments of said first and second members and respectively located adjacent to said pair of piercing terminals, each rotatable cam having an engagement section abutting against said movable section of said each piercing terminal and a handle section extending out from said main housing for rotating the engagement section to engage and move said movable section of said each piercing terminal inwardly, such that said retaining means of said movable section of said each piercing terminal engages and holds said each insulated conductor thereto while said piercing means of said movable section of said each piercing terminal pierces the insulation of said each insulated conductor to establish the electrical connection thereto.

2. The connector assembly in accordance with claim 1, wherein said plurality of different sized diameter conductors include an eight gauge conductor through a twenty-two gauge conductor.

3. The connector assembly in accordance with claim 1, wherein said retaining means of said movable section of said each piercing terminal includes a pair of spaced apart outwardly curved arms forming a jaw thereto to retain said each insulated conductor.

4. The connector assembly in accordance with claim 1, wherein said piercing means of said movable section of said each piercing terminal is generally shaped as a knife.

5. The connector assembly in accordance with claim 1, wherein said each flexible piercing terminal is made out of conductive material.

6. A connector assembly for quickly facilitating and establishing electrical connection with at least two insulated conductors, the connector assembly comprising:

a. a first half member;

b. a complementary second half member mateable with said first half member to form a main housing with at least two spaced apart apertures for receiving a plurality of different sized diameter insulated conductors of said at least two insulated conductors;

c. at least two piercing terminals positioned and secured between said first and second members and located parallel to each other, each piercing terminal having a movable section, a contact section extending out from the main housing and a flexible connection section connecting the movable section and the contact section, the movable section having a piercing means extending inwardly and a retaining means located adjacent to the piercing means; and d. at least two cams rotatably positioned and secured between said first and second members and respectively located adjacent to said at least two piercing terminal, each cam having an engagement section abutting against said movable section of said each piercing terminal and a handle section extending out from said main housing for rotating the engagement section to engage and move said movable section of said each piercing terminal inwardly, such that said retaining means of said movable section of said each piercing terminal engages and holds said each insulated conductor thereto while said piercing means of said movable section of said each piercing terminal pierces the insulation of said each insulated conductor to establish the electrical connection thereto.

7. The connector assembly in accordance with claim 6, wherein said plurality of different sized diameter conductors include an eight gauge insulated conductor through a twenty-two gauge insulated conductor.

8. The connector assembly in accordance with claim 6, wherein said retaining means of said movable section of said each piercing terminal includes a pair of spaced apart outwardly curved arms forming a jaw thereto to retain said each insulated conductor.

9. The connector assembly in accordance with claim 6, wherein said piercing means of said movable section of said each piercing terminal is generally shaped as a knife.

10. The connector assembly in accordance with claim 6, wherein said each flexible piercing terminal is made out of conductive material.

11. A connector assembly for quickly facilitating and establishing electrical connection with at least two insulated conductors, the connector assembly comprising:

a. a first half member;

b. a complementary second half member mateable with said first half member to form a main housing with at least two spaced apart apertures for receiving a plurality of different sized diameter insulated conductors of said at least two insulated conductors;

c. at least two piercing terminals installed between said first and second members, each piercing terminal having a movable section, a contact section extending out from the main housing and a flexible section connecting the movable section and the contact section, the movable section having a piercing means and a retaining means; and d. means for engaging and moving said movable section of said each piercing terminal, such that said retaining means of said movable section of said each piercing terminal engages and holds said each insulated conductor thereto while said piercing means of said movable section of said each piercing terminal pierces the insulation of said each insulated conductor to establish the electrical connection thereto.

12. The connector assembly in accordance with claim 11, wherein said plurality of different sized diameter conductors include an eight gauge insulated conductor through a twenty-two gauge insulated conductor.

13. The connector assembly in accordance with claim 11, wherein said retaining means of said movable section of said each piercing terminal includes a pair of spaced apart outwardly curved arms forming a jaw thereto to retain said each insulated conductor.

14. The connector assembly in accordance with claim 11, wherein said piercing means of said movable section of said each piercing terminal is generally shaped as a knife.

15. The connector assembly in accordance with claim 11, wherein said engaging and moving means includes at least two cams rotatably installed between said first and second members, each cam having an engagement section abutting against said movable section of said each piercing terminal and a handle section extending out from said main housing for rotating the engagement section to engage and move said movable section of said each piercing terminal.

16. The connector assembly in accordance with claim 11, wherein said each flexible piercing terminal is made out of conductive material.

17. A connector assembly for quickly facilitating and establishing electrical connection with at least one insulated conductor, the connector assembly comprising:

a. a first half member;

b. a second half member mateable with said first half member to form a main housing with at least one aperture for receiving a plurality of different sized diameter conductors of said at least one insulated conductor;

c. at least one piercing terminal installed between said first and second members and having a movable section, a contact section and a flexible section connecting the movable section and the contact section, the movable section having means for holding and penetrating the insulation of said at least one insulated conductor; and d. at least one cam rotatably installed between said first and second members and having means for engaging and moving said movable section, such that said holding and penetrating means engages and holds said at least one insulated conductor thereto while piercing the insulation of said at least one insulated conductor to establish the electrical connection thereto.

18. The connector assembly in accordance with claim 17, wherein said plurality of different sized diameter conductors include an eight gauge insulated conductor through a twenty-two gauge insulated conductor.

19. The connector assembly in accordance with claim 17, wherein said holding and penetrating means includes a pair of spaced apart outwardly curved arms forming a jaw thereto to retain said at least one insulated conductor and a generally shaped knife.

20. The connector assembly in accordance with claim 17, wherein said engaging and moving means includes an engagement section abutting against said movable section and a handle section extending out from said main housing for rotating the engagement section to engage and move said movable section.

21. The connector assembly in accordance with claim 17, wherein said at least one piercing terminal is made out of conductive material.

22. The connector assembly in accordance with claim 17, wherein said contact section further includes a connecting end extending out from said main housing for connecting to an electronic device.

23. A connector for quickly facilitating and establishing electrical connection with at least one insulated conductor, the connector comprising:

a. a shell having at least one aperture for receiving said at least one insulated conductor thereto;

b. at least one piercing terminal installed within said shell and having a movable section, a contact section and a flexible section connecting the movable section and the contact section, the movable section having a piercing means and a retaining means; and c. means for engaging and moving said movable section such that said retaining means engages and holds said at least one insulated conductor thereto while said piercing means pierces the insulation of said at least one insulated conductor to establish the electrical connection thereto.

24. The connector in accordance with claim 23, wherein said plurality of different sized diameter conductors include an eight gauge insulated conductor through a twenty-two gauge insulated conductor.

25. The connector in accordance with claim 23, wherein said retaining means includes a pair of spaced apart outwardly curved arms forming a jaw thereto to retain said at least one insulated conductor.

26. The connector in accordance with claim 23, wherein said piercing means is generally shaped as a knife.

27. The connector in accordance with claim 23, wherein said at least one piercing terminal is made out of conductive material.

28. The connector in accordance with claim 23, wherein said contact section further includes a connecting end extending out from said shell for connecting to an electronic device.

29. The connector in accordance with claim 23, wherein said engaging and moving means includes at least one cam rotatably installed within said shell, the at least one cam having an engagement section abutting against said movable section and a handle section extending out from said shell for rotating the engagement section to engage and move said movable section.

* * * * *